US007128301B2

(12) United States Patent
Shepard et al.

(10) Patent No.: US 7,128,301 B2
(45) Date of Patent: Oct. 31, 2006

(54) TWO PIECE CALENDAR HOLDER

(75) Inventors: Sandra Shepard, Berkeley, CA (US); Raffi Minasian, Walnut Creek, CA (US)

(73) Assignee: Meadwestvaco Corporation, Smyrna, GA (US)

( * ) Notice: Subject to any disclaimer, the term of this patent is extended or adjusted under 35 U.S.C. 154(b) by 0 days.

(21) Appl. No.: 10/641,475

(22) Filed: Aug. 14, 2003

(65) Prior Publication Data

US 2004/0069921 A1 Apr. 15, 2004

Related U.S. Application Data

(60) Provisional application No. 60/403,257, filed on Aug. 14, 2002.

(51) Int. Cl.
*G09F 7/22* (2006.01)
*A47B 23/04* (2006.01)

(52) U.S. Cl. ..... 248/447.1; 248/201; 248/452; 248/453; 40/617; 40/611.12; 40/658

(58) Field of Classification Search ..... 248/441.1, 248/447.1, 451–453, 201, 317, 320; 211/45; 24/67.7, 67.11, 509–511; 40/745, 747, 757, 40/658, 617, 611.12
See application file for complete search history.

(56) References Cited

U.S. PATENT DOCUMENTS

| | | | | | |
|---|---|---|---|---|---|
| 218,488 | A | * | 8/1879 | Christie | 24/67.7 |
| 256,248 | A | | 4/1882 | Slafter | |
| 270,283 | A | | 1/1883 | Coulter | |
| 312,702 | A | * | 2/1885 | Bourne | 24/67.7 |
| 314,769 | A | * | 3/1885 | Yeiser | 24/67.7 |
| 318,372 | A | | 5/1885 | Hannas et al. | |
| 793,914 | A | * | 7/1905 | Shumaker | 211/50 |
| 2,530,821 | A | | 11/1950 | Hubbell | |
| 3,350,045 | A | | 10/1967 | Mayers | |
| 3,671,004 | A | | 6/1972 | Cram | |
| 3,780,402 | A | * | 12/1973 | Takabayashi | 24/510 |
| 3,828,402 | A | * | 8/1974 | Gorman | 24/67.5 |
| 3,914,892 | A | | 10/1975 | Mohr | |
| 3,979,846 | A | | 9/1976 | Euzarraga | |
| 4,085,703 | A | * | 4/1978 | Glowacki | 118/504 |
| 4,512,094 | A | | 4/1985 | Seely | |
| 4,523,400 | A | | 6/1985 | Seely | |
| 4,629,075 | A | | 12/1986 | Hutten | |
| 4,826,124 | A | | 5/1989 | Kindig | |
| 4,899,974 | A | | 2/1990 | Wear et al. | |
| 4,918,847 | A | * | 4/1990 | Lee | 40/745 |
| 5,096,069 | A | | 3/1992 | Brandon | |
| 5,251,766 | A | | 10/1993 | Barry | |
| 5,364,057 | A | | 11/1994 | Pynenburg | |
| 5,518,217 | A | | 5/1996 | Deutsch et al. | |

(Continued)

FOREIGN PATENT DOCUMENTS

JP 02000335142 A * 12/2000

*Primary Examiner*—Korie Chan
(74) *Attorney, Agent, or Firm*—Fulbright & Jaworsk LLP

(57) ABSTRACT

A holder for decorative sheet material comprising two separate pieces, one piece for attaching to an upper edge portion of a sheet material and for hanging from a wall, the other piece for attaching to a lower edge portion of the sheet material. Each piece of the holder comprises a top plate and a base plate hingedly connected together, and means such as a post, adhesive tape or spring-loaded clip for connecting the sheet material to the base plate. In particular embodiments, spring-loaded clips both hingedly connect the top and base plates, and act as a means to connect the sheet material to the base plate.

12 Claims, 2 Drawing Sheets

U.S. PATENT DOCUMENTS 5,662,303 A 9/1997 Rellinger et al.
6,158,597 A 12/2000 McDermott
6,257,422 B1 7/2001 Rios
6,405,983 B1 6/2002 Goj
6,678,982 B1 1/2004 Pitcher et al.

* cited by examiner

FIG. 3
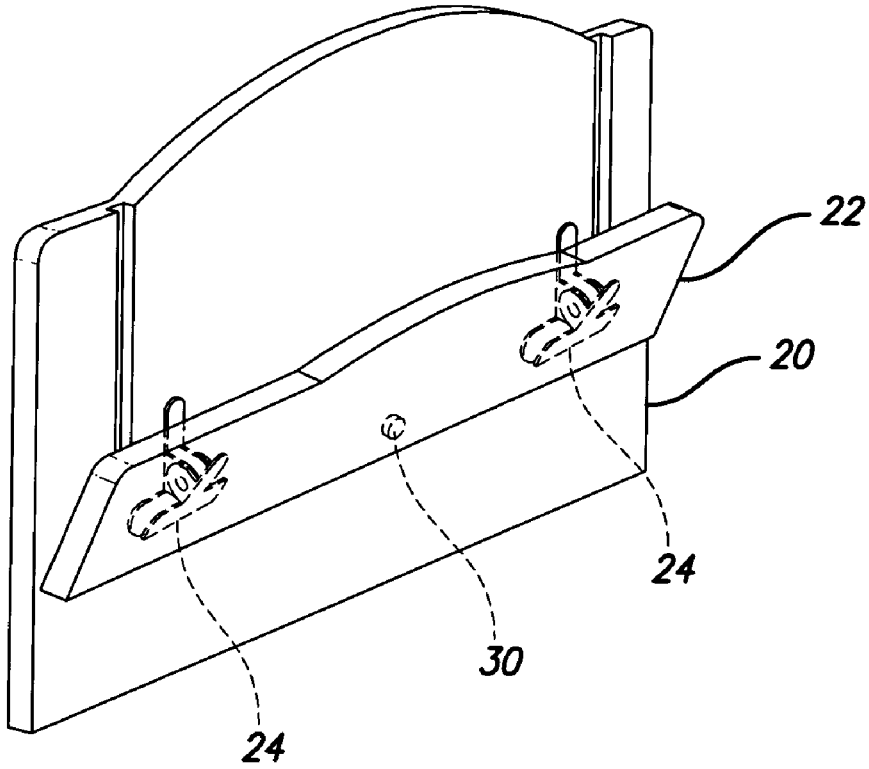
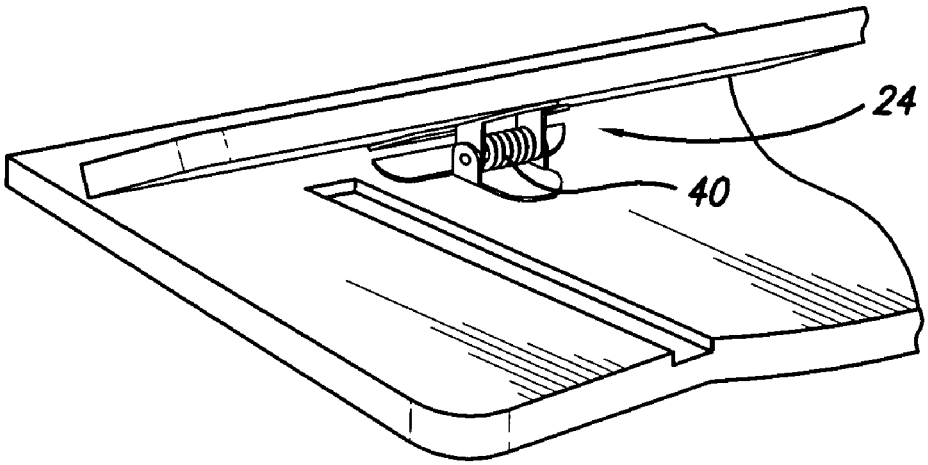
FIG. 4

TWO PIECE CALENDAR HOLDER

CROSS-REFERENCE TO RELATED APPLICATIONS

This application claims the benefit of provisional application No. 60/403,257 filed on Aug. 14, 2002.

BACKGROUND

1. Field of Invention

This invention relates generally to holders for hanging sheet materials and in particular to holders for hanging calendars from walls.

2. Related Art

Calendars and other decorative sheet materials such as posters, papers, tapestries, quilts, fabrics, charts and the like are typically hung from walls using hooks, nails or clips. Although functional, this way of presenting decorative sheet materials is aesthetically limited. Further, the pages of calendars hung in this manner have a tendency to curl and the bottom pages to bow. Another way to present calendars is by means of a frame. However, such frames are relatively bulky, especially when large calendars are involved. What is needed is a holder for decorative sheet materials that is aesthetically appealing, that keeps sheet materials flat, and that is less bulky that a frame.

SUMMARY

The present invention provides a holder for decorative sheet materials. The holder comprises two unjoined pieces, one piece for connecting to an upper edge portion of a sheet material and for hanging from a wall, the other piece for connecting to a lower edge portion of the sheet material. Each piece comprises a top plate and a base plate hingedly connected together, allowing for an edge portion of the sheet material to be inserted between the two plates, and means for connecting the sheet material to the base plate.

The holder will become better understood from the following detailed description and accompanying drawings. It is to be expressly understood, however, that each of the figures is provided for the purpose of illustration and description only and is not intended as a definition of the limits of the present invention.

BRIEF DESCRIPTION OF THE DRAWINGS

FIG. 3 is a perspective view of a holder piece having two spring-loaded clips and a post; and FIG. 4 is a perspective view of a spring-loaded clip hingedly connecting top and base plates.

DETAILED DESCRIPTION

In accordance with an embodiment of the present invention, a holder for a calendar comprises two unjoined pieces. Each piece of the calendar holder comprises a top and base plate hingedly connected together, and means for connecting the calendar to the base plate. The calendar is connected to the base plate by means well known in the art such as a protruding element, an adhesive element, and a spring-loaded clip. The protruding element inserts into a hole typically present in a calendar and can be a post, nail, hook, screw, hanger or the like. The adhesive element sticks the edge portion of a calendar to the base plate and can be adhesive tape, a velcro fastener, glue or the like. The spring-loaded clip grips the calendar between jaws that can have teeth or a covering of grip-enhancing material such as rubber or rubber-like compounds. In this way, the holding ability of the jaws can be increased.

The base plate alone adequately supports the calendar, so it is not necessary for the top and base plates to cooperatively hold the calendar.

Although the two pieces will usually have the same means for connecting the calendar to the base plate, each piece can have a different means. For example, the piece connecting the upper edge portion of a calendar can have a post, while the other piece can have a spring-loaded clip. Also, each piece can have multiple connecting means. For example, a piece can have both a spring-loaded clip and a post.

Figure 1:
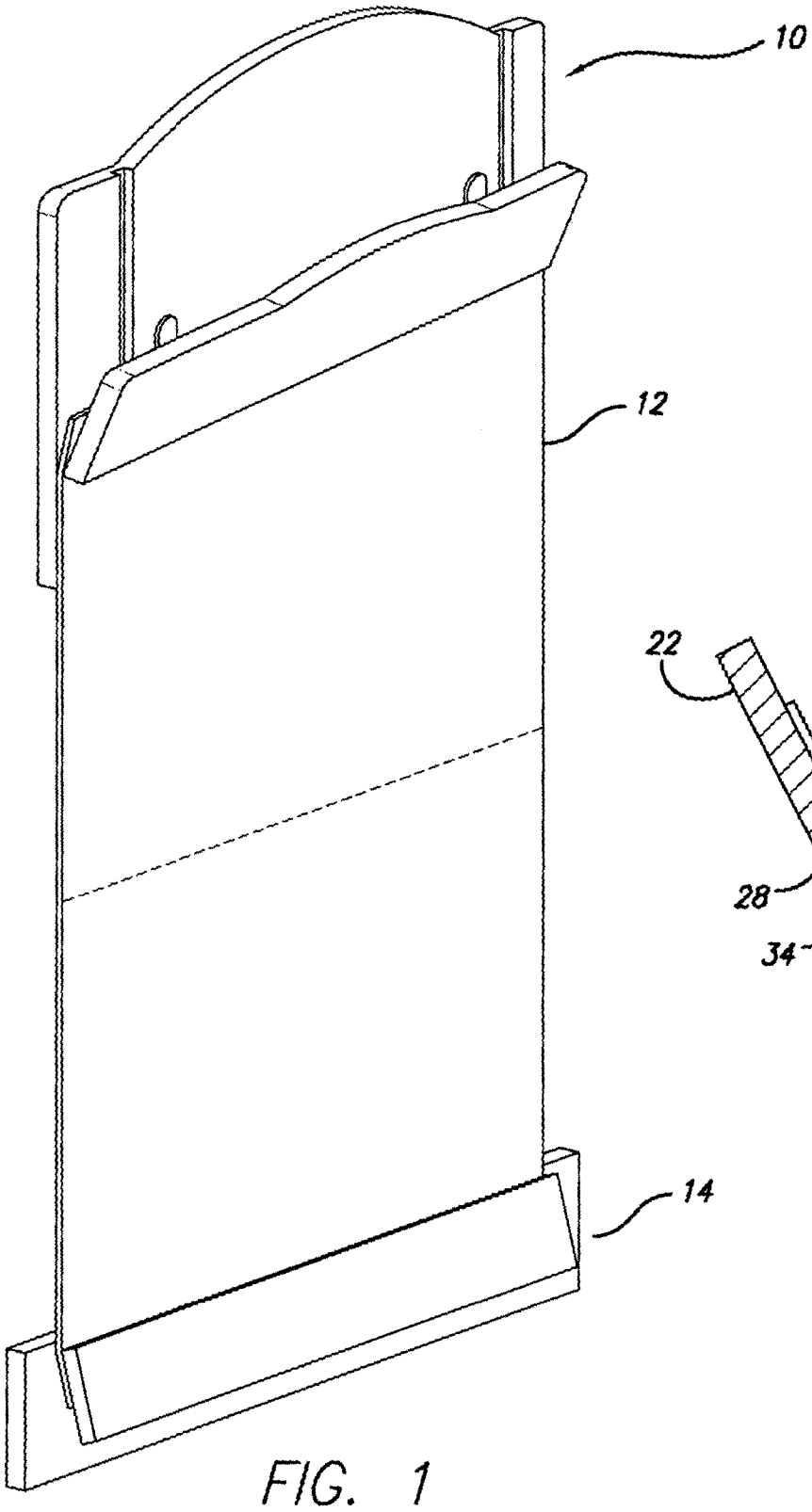
FIG. 1 is a perspective view showing an upper and lower piece attached to a calendar hanging from a wall.

FIG. 1 shows a calendar holder in accordance with the present invention. The holder comprises two separate and unjoined pieces, an upper piece 10 for attaching to the top of an open calendar 12, and a lower piece 14 for attaching to the bottom of the calendar. The calendar is hung from the wall by the upper piece, which has a conventional means for hanging such as a looped picture hanger.

Figure 2:
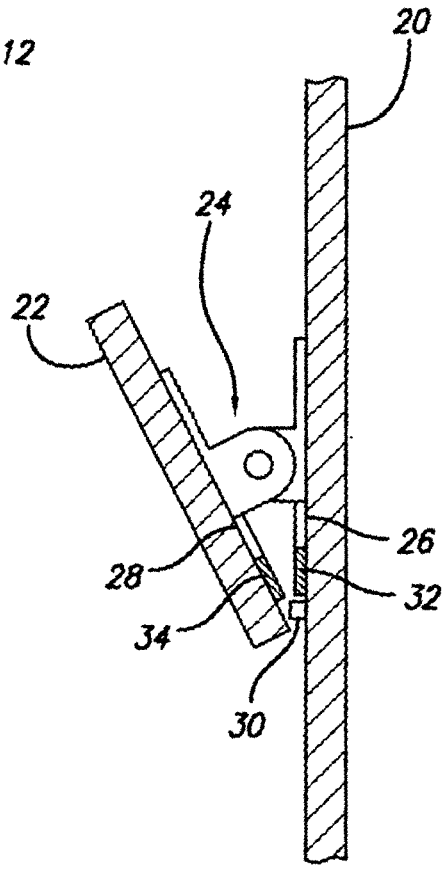
FIG. 2 is a side-view of a holder piece having a post and a spring-loaded clip.

Referring to FIGS. 2 and 3, each piece comprises two plates, a base plate 20 and a top plate 22 which are hingedly connected together. When connected, the top plate is biased relative to the base such that a portion of the inner face of the top plate is in close proximity to a portion of the upper surface of the base plate. Although the inner face of the top plate can touch the upper surface of the base plate, contact is not required so long as the inner face and upper surface are close enough to confine calendar pages therebetween.

Two spring-loaded clips 24 hingedly connect the two plates. One arm 26 of each clip is fixedly secured to the base plate, and the other arm 28 of each clip is fixedly secured to the top plate. FIG. 4 is a view of the spring-loaded clip 24 showing one arrangement of the attached spring 40. Referring again to FIGS. 2 and 3, when the jaws of the clips are closed, the inner surface of the biased top plate 22 is in close proximity to the upper surface of the base plate 20. Pushing on the top plate opposite the contacting surfaces forces the base and top plates to open, allowing a calendar to be inserted between the surfaces. Although a spring-loaded clip is described, other means of hingedly connecting the top and base plates are well known in the art.

A post 30 projects out of the upper surface of the base plate 20 of each piece. The post inserts into a hole that is typically present in calendars for use in hanging calendars from walls. The post is positioned under the top plate such that a calendar can attach to the post while an edge portion of the calendar is confined between the top and base plates.

In practice, the top plate 22 and base plate 20 of the upper piece 10 are held open and the desired pages of a calendar are inserted between the plates. The pages are placed over the post 30 by inserting the post into the calendar hole typically present in the pages. The lower piece 14 is attached to the bottom of the calendar in a similar manner. The calendar can be hung from a wall by attaching the hanging means of the upper piece 10 to the wall. Because the post actually holds the calendar to the upper piece, the calendar can hang while the top and base plates of the upper piece are held open. This provides the advantage that a calendar page can be removed or turned over without removing the calendar from the upper piece or the wall. A further advantage of the post is that the force keeping the top and base plates in close proximity can be relatively weak since the plates are not required to hold up the calendar. Thus, the top and base plates can be configured to open easily.

In other embodiments, the post is located between the two spring-loaded clips such that the calendar can attach to the post while an edge portion of the calendar is gripped by the jaws of the spring-loaded clips. Thus, the calendar is connected to the base plate by both the post and the jaws of the clips. In this arrangement, each clip performs the dual functions of hingedly connecting the top and base plates and acting as a means to connect the calendar to the base plate.

To enhance gripping ability, the jaws of each clip can be covered with rubber. For example, the clip shown in FIG. 2 has rubber-tipped jaws 32 and 34.

In a preferred embodiment, the post is eliminated and the clips alone hold the calendar while also hingedly connecting the top and base plates. In another preferred embodiment, both post and clips are present in the upper piece 10, while only clips are present in the lower piece 14, with the respective clips hingedly connecting the top and base plates in both pieces.

The calendar holder is not limited to the particular plates shown in the figures, and top and base plates of various sizes and shapes are readily apparent to those skilled in the art. Also, the top and base plates can be constructed of materials well known in the art such as wood, plastic, metal and combinations thereof.

What is claimed is:

1. A holder for hanging decorative sheet material, the holder comprising:

a) a first piece for connecting to an upper edge portion of the sheet material; and b) a second piece, unjoined to the first piece, for connecting to a lower edge portion of the sheet material;

wherein each piece comprises:

i) a base plate, ii) a top plate hingedly connected to the base plate for insertion of an edge portion of the sheet material between the top and base plates, and iii) two spring-loaded clips for connecting the sheet material to the base plate, each clip comprising a coiled spring and further comprising jaws for gripping the sheet material.

2. The holder of claim 1 wherein the top plate is hingedly connected at an inclined angle to the base plate.

3. The holder of claim 1, wherein at least one of the first piece and the second piece further comprises a protruding element for inserting into a hole in the sheet material.

4. The holder of claim 3 wherein the protruding element is a post, nail, screw, hook or hanger.

5. The holder of claim 3 wherein the protruding element is a post.

6. The holder of claim 1 wherein the top and base plates are hingedly connected by the clips.

7. The holder of claim 1 wherein the jaws have teeth for gripping.

8. The holder of claim 1 wherein the jaws are covered with a grip-enhancing material.

9. The holder of claim 8 wherein the material is rubber.

10. A holder for hanging a calendar, the holder comprising a) a first piece for connecting to an upper edge portion of the calendar; and b) a second piece unjoined to the first piece, for connecting to a lower edge portion of the calendar;

wherein each piece comprises:

i) a base plate, ii) a top plate hingedly connected to the base plate for insertion of a calendar edge portion between the top and base plates, and iii) two spring-loaded clips for hingedly connecting the top and base plates and for connecting the calendar to the base plate, each clip comprising a coiled spring and further comprising jaws for gripping the calendar.

11. The holder of claim 10 wherein the jaws of each clip are covered with rubber.

12. The holder of claim 10 further comprising a post in the base plate of the first piece, for inserting into a hole in the calendar.

* * * * *